US005529874A

United States Patent [19]

Kobayashi et al.

[11] Patent Number: 5,529,874

[45] **Date of Patent: *Jun. 25, 1996**

[54] LIQUID DEVELOPER FOR ELECTROPHOTOGRAPHY

[75] Inventors: Takako Kobayashi; Hirotaka Matsuoka; Ken Hashimoto, all of Minami Ashigara, Japan

[73] Assignee: Fuji Xerox Co., Ltd., Tokyo, Japan

[ * ] Notice: The term of this patent shall not extend beyond the expiration date of Pat. No. 5,352,557.

[21] Appl. No.: 471,667

[22] Filed: Jun. 6, 1995

Related U.S. Application Data

[63] Continuation of Ser. No. 235,712, Apr. 29, 1994, abandoned.

[30] Foreign Application Priority Data

May 27, 1993 [JP] Japan ..... 5-130076
Oct. 25, 1993 [JP] Japan ..... 5-287336

[51] Int. Cl.[6] ..... G03G 9/125

[52] U.S. Cl. ..... 430/116; 430/112; 430/115

[58] Field of Search ..... 430/112, 115, 430/116

[56] References Cited

U.S. PATENT DOCUMENTS

| | | | |
|---|---|---|---|
| 3,264,272 | 8/1966 | Rees . | |
| 3,290,251 | 12/1966 | Nelson | 430/115 |
| 4,794,651 | 12/1988 | Landa et al. | 430/110 |
| 5,266,435 | 11/1993 | Almog | 430/115 |
| 5,352,557 | 10/1994 | Matsuoka et al. | 430/116 |

FOREIGN PATENT DOCUMENTS

| | | |
|---|---|---|
| 35-5511 | 5/1960 | Japan . |
| 36-14872 | 8/1961 | Japan . |
| 38-2234 | 3/1963 | Japan . |
| 38-22343 | 10/1963 | Japan . |
| 40-19186 | 8/1965 | Japan . |
| 43-13519 | 6/1968 | Japan . |
| 45-14545 | 5/1970 | Japan . |
| 51-89428 | 8/1976 | Japan . |
| 56-9189 | 2/1981 | Japan . |
| 58-2851 | 1/1983 | Japan . |
| 58-129438 | 8/1983 | Japan . |
| 58-152258 | 9/1983 | Japan . |
| 63-16735 | 1/1988 | Japan . |
| 2-6967 | 1/1990 | Japan . |
| 2-6965 | 1/1990 | Japan . |

OTHER PUBLICATIONS

K. A. Metcalfe, "Liquid developers for xerography," *Journal of Scientific Instruments,* vol. 32, Feb. 1955, pp. 74–75.

K. A. Metcalfe et al., "Fine grain development in xerography," *Journal of Scientific Instruments,* vol. 33, May 1956, pp. 194–195.

*Primary Examiner*—Janis L. Dote
*Attorney, Agent, or Firm*—Oliff & Berridge

[57] ABSTRACT

A liquid developer for electrophotography comprising a carrier liquid having dispersed therein toner particles containing a binder resin and a colorant, wherein said carrier liquid contains at least one ether compound selected from compounds represented by formula (I) and compounds represented by formula (II):

$$R_1—O(C_nH_{2n}O)_x—R_2 \quad (I)$$

$$R_3—O—R_4 \quad (II)$$

wherein $R_1$, $R_2$, $R_3$, and $R_4$, which may be the same or different, each represent an alkyl group, an alicyclic alkyl group, an aryl group, or an aralkyl group; n represents an integer of from 4 to 8; and x represents 1 or 2. The developer requires no heating even in winter and is less vaporized and less dangerous owing to the low solidifying point and low vapor pressure of the carrier liquid. The developer stably exhibits satisfactory charging properties. The developer is suited to high-speed copying.

6 Claims, 1 Drawing Sheet

FIGURE
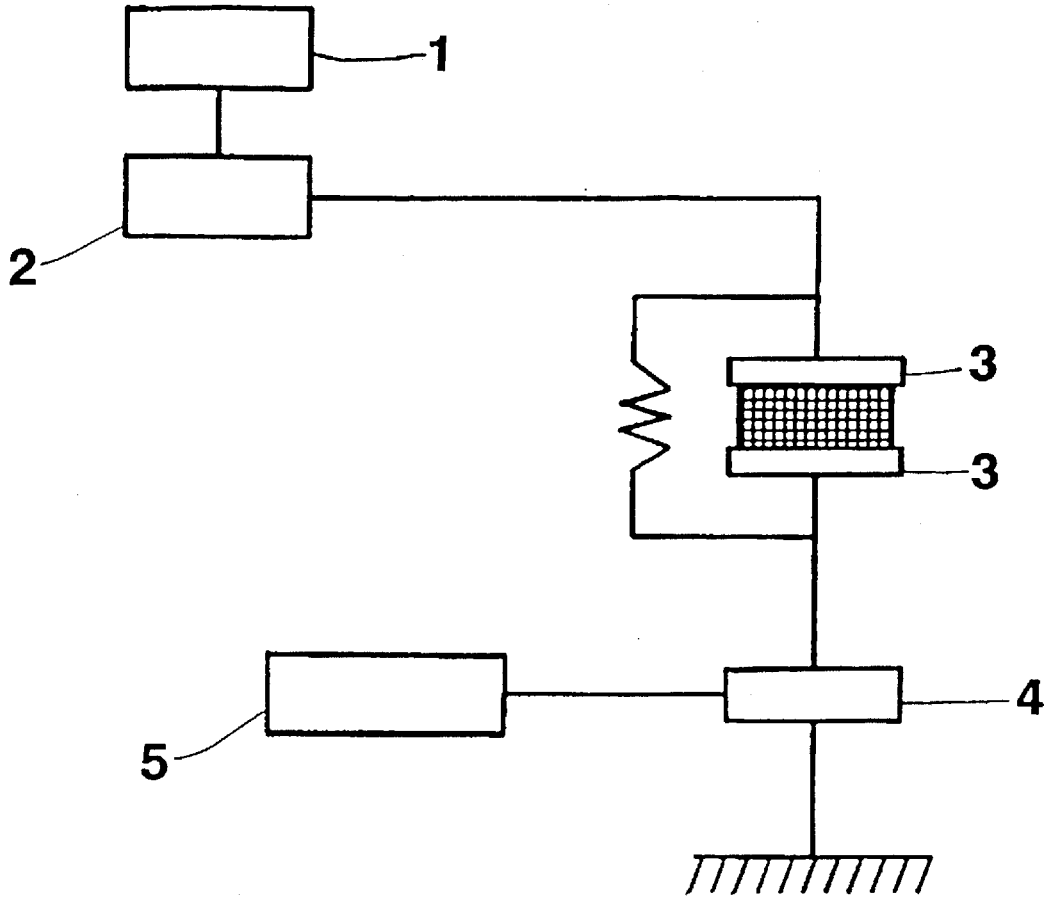

LIQUID DEVELOPER FOR ELECTROPHOTOGRAPHY

This is a continuation of application Ser. No. 08/235,712 filed Apr. 29, 1994, now abandoned.

FIELD OF THE INVENTION

The present invention relates to a liquid developer for electrophotography using an ether compound as a carrier liquid.

BACKGROUND OF THE INVENTION

Wet development in electrophotography is generally carried out by developing an electrostatic latent image on an electrophotographic photoreceptor with a liquid developer comprising a dispersing medium, usually an aliphatic hydrocarbon, having dispersed therein toner particles mainly comprising a resin and a colorant. The thus formed toner image is transferred to transfer paper and fixed thereon.

Where photosensitive paper or film coated with a photoconductive material, such as lead oxide, is used as a photoreceptor, the transfer process may be omitted, that is, the toner image may be fixed on the photoreceptor.

Wet development is also often employed as a development system for electrostatic recording consisting of forming an electrostatic latent image on a dielectric film by means of electrodes without using a photoreceptor.

The wet development system is primarily based on electrophoresis of fine toner particles of from submicrons to several microns in a carrier liquid having high electrical resistance, such as an aliphatic hydrocarbon. Therefore, this system is characterized by ease of attaining higher resolving power than by dry development system using toner particles of several microns or greater.

According to the early literature produced by K. A. Metcalfe (*J. Sci. Instrum.*, Vol. 32, p. 74 (1955) and *ibid*, vol. 33, p. 194 (1956)), useful pigments for liquid developers include carbon black, magnesium oxide and other various organic or inorganic pigments, and useful carrier liquids include gasoline, kerosine, and carbon tetrachloride.

The early patent publications by Metcalfe mention usefulness, as a carrier liquid, of halogenated hydrocarbons (JP-B-35-5511, the term "JP-B" as used herein means an "examined published Japanese patent application"), polysiloxanes (JP-B-36-14872), ligroin, and mixtures of these petroleum hydrocarbons (JP-B-38-22343 and JP-B-43-13519).

Patent publications relating to preparation of toners also contain frequent references to a liquid carrier. For example, JP-B-40-19186, JP-B-45-14545, and JP-B-56-9189 describe that aromatic hydrocarbons, such as benzene, toluene and xylene, and aliphatic hydrocarbons, such as n-hexane, isododecane, Isopar G, H, L, M or V (product of Exxon Chemical Corp.), are useful as a carrier liquid, which sometimes serve as a dispersing medium for polymerization.

Because most of these carrier liquids proposed to date are organic solvents of high vapor pressure, there are involved such problems that: (1) they vaporize on fixing, etc., tending to cause environmental pollution; (2) they are flammable; and (3) they remain in transfer paper after fixing and give off a solvent smell.

In order to solve these problems, it has been proposed to decrease the vapor pressure of a carrier liquid by using a hydrocarbon type petroleum solvent of low vapor pressure or a polymerized hydrocarbon which is solid at ambient temperature (see, for example, JP-A-63-167375, JP-A-2-6965, and JP-A-2-6967, the term "JP-A" as used herein means an "unexamined published Japanese patent application").

However, if the molecular weight of a hydrocarbon is increased in an attempt to reduce the vapor pressure, it generally follows that the viscosity of the carrier liquid increases, tending to adversely affect the rate of development. Besides, the melting point of the carrier liquid also increases to approximately room temperature so that development always needs heating, which will cause reduction in copying speed and necessity of much heat energy in the development and fixing parts in actual development operation, and which will lead to waste of energy, thermal pollution, and deterioration of a developer.

Use of a hydrocarbon solution having a resistivity of not less than $10^9$ Ω•cm and a dielectric constant of not more than 3.0 as a carrier liquid is taught in JP-A-51-89428. Like this, conventionally proposed carrier liquids are mostly non-polar hydrocarbon solutions having a high resistivity and a low dielectric constant. It is experimentally known in the art that a carrier liquid whose resistivity is lower than an adequate level breaks a latent image on a photoreceptor or causes a bias leak in the development and transfer parts, failing to obtain a satisfactory image.

Additionally, developers containing a non-polar carrier liquid having an excessively high resistivity and a low dielectric constant have not always produced satisfactory results with respect to toner charging properties and toner charge stability with time. That is, there has been a tendency that the charge quantity of a toner decreases with time or the proportion of a toner charged to the opposite polarity increases.

Hence, under the present situation, a satisfactory carrier liquid for a liquid developer has not yet been developed.

SUMMARY OF THE INVENTION

An object of the present invention is to provide a carrier liquid for a liquid developer which is odorless, has less danger of fire and is less vaporized from copying machines or printers.

Another object of the present invention is to provide a carrier liquid which performs excellent function in charging a toner and stabilizing the charge of the toner.

A further object of the present invention is to provide a carrier liquid for a liquid developer which is applicable to high-speed copying in full color as well as in black-and-white.

As a result of extensive investigations, the present inventors have found that a carrier liquid selected from an ether compound of a long-chain alcohol (e.g., butanol, pentanol, hexanol, heptanol or octanol) and a diether compound of butylene glycol, pentylene glycol, hexylene glycol, heptylene glycol, octylene glycol or a dimer thereof is practically equal to a conventional carrier liquid in viscosity, much less vaporized on fixing than a conventional carrier liquid, and exhibits excellent charging properties and charge stability. The present invention has been completed based on this finding.

The present invention relates to a liquid developer for electrophotography comprising a carrier liquid having dispersed therein toner particles containing a binder resin and a colorant, wherein the carrier liquid contains at least one ether compound selected from compounds represented by formula (I) and compounds represented by formula (II):

$$R_1—O(C_nH_{2n}O)_x—R_2 \quad (I)$$

$$R_3—O—R_4 \quad (II)$$

wherein $R_1$, $R_2$, $R_3$, and $R_4$, which may be the same or different, each represent an alkyl group, an alicyclic alkyl group, an aryl group, or an aralkyl group; n represents an integer of from 4 to 8; and x represents 1 or 2.

BRIEF DESCRIPTION OF THE DRAWING

FIGURE is a circuit diagram of an apparatus for measuring charged toner quantity.

DETAILED DESCRIPTION OF THE INVENTION

In formulae (I) and (II), groups represented by $R_1$, $R_2$, $R_3$ or $R_4$ include straight-chain or branched alkyl group, such as methyl, ethyl, n-propyl, isopropyl, n-butyl, isobutyl, sec-butyl, t-butyl, n-pentyl, isopentyl, neopentyl, 1,1-dimethylpropyl, n-hexyl, isohexyl, 2-ethylbutyl, n-heptyl, isoheptyl, n-octyl, iso-octyl, 2-ethylhexyl, n-nonyl, isononyl, n-decyl, isodecyl, and 2-ethyloctyl groups; alicyclic alkyl groups, such as cyclopentyl, cyclohexyl, and methylcyclohexyl groups; aryl groups, such as phenyl, tolyl, xylyl, and naphthyl groups; and aralkyl groups, such as benzyl, phenethyl, and phenylpropyl groups. $R_1$ and $R_2$ in formula (I) and $R_3$ and $R_4$ in formula (II) may be the same or different. An (alicyclic) alkyl group represented $R_1$, $R_2$, $R_3$ or $R_4$ preferably has 4 to 16 carbon atoms. An aryl group represented by $R_1$, $R_2$, $R_3$ or $R_4$ preferably has 8 to 16 carbon atoms. An aralkyl group represented by $R_1$, $R_2$, $R_3$ or $R_4$ preferably has 9 to 16 carbon atoms.

The ether compounds of formulae (I) and (II) have appropriate characteristics as a carrier liquid of a liquid developer in terms of insulating properties, viscosity, toner binder dissolving power, and low pour point. They have a markedly reduced vapor pressure as compared with conventional carrier liquids. Additionally, they are odorless. These excellent characteristics are believed to be attributed to the length of the hydrophobic end groups (the kinds and carbon atom numbers of $R_1$ and $R_2$ in formula (I) or $R_3$ and $R_4$ in formula (II)), the kind and the number of ethereal polar groups in the molecular chain and/or the length of the hydrophobic moiety of a starting diol (the number represented by n in formula (I)).

Considerations will hereinafter be given to the relation between the chemical structure of these ether compounds and their performance as a carrier liquid.

The length of the hydrophobic group is believed (i) to lessen interaction among polar groups, such as a hydrogen bond thereby decreasing the viscosity, (ii) to raise resistivity up to a level which is experimentally deemed useful, (iii) to increase compatibility to a binder resin, for example, an olefin resin, and (iv) to be correlated with vapor pressure within a certain range.

In order to take advantage of these characteristics, it is preferable that the total number of the carbon atoms in $R_1$ and $R_2$ is between 4 and 20 or that in $R_3$ and $R_4$ is from 8 to 20. If the total carbon atom number of $R_1$ and $R_2$ is less than 4 or that of $R_3$ and $R_4$ is less than 8, resistivity tends to increase more than necessary, the dissolving power for an olefin resin tends to be reduced, and the vapor pressure tends to increase excessively. If the total carbon atom number of $R_1$ and $R_2$ or that of $R_3$ and $R_4$ exceeds 20, the viscosity tends to increase more than desired, resulting in reduction in speed of development dependent on electrophoretic force. Further, the melting point increases to approximately room temperature. As previously stated, this means that heat must always be applied to a liquid developer for carrying out development, which is economically disadvantageous and also deteriorates reliability on repetition of heat cycles.

The ether group in the molecular chain is considered to have influences on the solidifying point, toner charging properties, and toner binder dissolving power. For example, according as the molecular weight of a straight chain hydrocarbon increases, the solidifying point is elevated up to around room temperature. To the contrary, the ether compound of the present invention, with its molecular weight being substantially equal to that of the above-mentioned straight chain hydrocarbon, shows a reduction of solidifying point. That is, the compound of the present invention serves sufficiently as a carrier liquid even in winter.

Compared with hydrocarbons having substantially the same molecular weight, the ether compound of the present invention is superior in function of imparting charges to a toner. That is, the liquid carrier of the present invention accelerates or stabilizes charge exchange with a toner. Further, where a charge control agent, such as a so-called charge director, is added to a liquid developer, the compound of the present invention controls the dispersibility and solubility of the charge control agent thereby improving charge stability as a developer. These effects appear to be produced owing to the polarity of the ether group in the molecular chain.

The ether compounds represented by formula (I) will be explained below in detail.

General-purpose glycols in industry typically include short-chain glycols, such as ethylene glycol and propylene glycol; and polyoxyalkylene glycols comprising such short-chain glycols as a repeating unit, such as diethylene glycol and dipropylene glycol. Diethers prepared from short-chain glycols are represented by formula (I) wherein n is less than 4. Diethers according to the present invention, prepared from long-chain glycols, are represented by formula (I) wherein n is an integer of from 4 to 8, preferably an integer of from 4 to 6.

A diether of a glycol must have a certain total molecular chain length so as to serve as a carrier liquid having a moderately low vapor pressure and satisfactory charging properties and charge stability. If a dialkyl ether having a molecular chain length enough to have such characteristics is prepared from a short-chain glycol, one or both of the hydrophobic ends groups (corresponding to $R_1$ and $R_2$) must have a considerably long chain. This would follow that the interaction among the hydrophobic groups at one end or both ends increases and the dialkyl ether is liable to have increased viscosity over that prepared from a long-chain glycol. Moreover, a dialkyl ether prepared from a short-chain glycol and having a long-chain hydrophobic group at the terminals thereof and still having high purity is less available due to its high viscosity, tending to increase the cost. Additionally, because of the short distance between oxygen atoms in the molecule, the hydrogen bond between the ethereal oxygen atom and a water molecule becomes strong, easily resulting in moisture absorption in a high temperature and high humidity environment. As a result, electrical conductivity is apt to increase excessively.

If the carbon atom number n of a glycol exceeds 8, the diester of such a long-chain glycol, for example a dialkyl ether, has an increased viscosity or a solidifying point increased to room temperature (solidifies at room temperature) irrespective of whether the alkyl group is straight or branched. From all these considerations, the carbon atom number n of the glycol should be between 4 and 8.

In other words, the ether compound (I) of the present invention controls the water content in the carrier liquid and prevents excessive increase of conductivity while achieving the purposes of low viscosity and low vaporizability.

Should the unit number x in the molecular chain be 3 or more, the whole developer system would have increased hydrophilic properties and, as a result, the carrier liquid would have excessively increased conductivity. To avoid this, the unit number x of the glycol must be 1 or 2.

Thus, the liquid developer according to the present invention has a controlled viscosity and, as a result, makes high-speed copying feasible.

The ether compounds represented by formula (I) wherein x is 1 include diethers of 1,4-butylene glycol, such as 1,4-butylene glycol diethyl ether, 1,4-butylene glycol dipropyl ether, 1,4-butylene glycol dibutyl ether, 1,4-butylene glycol dipentyl ether, 1,4-butylene glycol dihexyl ether, 1,4-butylene glycol diheptyl ether, 1,4-butylene glycol dioctyl ether, 1,4-butylene glycol dinonyl ether, 1,4-butylene glycol didecyl ether, 1,4-butylene glycol dicyclohexyl ether, 1,4-butylene glycol diphenyl ether, 1,4-butylene glycol ditolyl ether, 1,4-butylene glycol dixylyl ether, 1,4-butylene glycol butyl naphthyl ether, 1,4-butylene glycol dibenzyl ether, 1,4-butylene glycol ethyl butyl ether, 1,4-butylene glycol butyl hexyl ether, and 1,4-butylene glycol butyl 2-ethylhexyl ether, and similar diethers of 1,2-butylene glycol, 1,3-butylene glycol or 2,3-butylene glycol; diethers of 1,5-pentylene glycol, such as 1,5-pentylene glycol diethyl ether, 1,5-pentylene glycol dipropyl ether, 1,5-pentylene glycol dibutyl ether, 1,5-pentylene glycol dipentyl ether, 1,5-pentylene glycol dihexyl ether, 1,5-pentylene glycol diheptyl ether, 1,5-pentylene glycol dioctyl ether, 1,5-pentylene glycol dinonyl ether, 1,5-pentylene glycol didecyl ether, 1,5-pentylene glycol dicyclohexyl ether, 1,5-pentylene glycol diphenyl ether, 1,5-pentylene glycol ditolyl ether, 1,5-pentylene glycol dixylyl ether, 1,5-pentylene glycol butyl naphthyl ether, 1,5-pentylene glycol dibenzyl ether, 1,5-pentylene glycol ethyl butyl ether, 1,5-pentylene glycol butyl hexyl ether, and 1,5-pentylene glycol butyl 2-ethylhexyl ether, and similar diethers of 1,2-pentylene glycol, 1,3-pentylene glycol, 1,4-pentylene glycol, 2,3-pentylene glycol or 2,4-pentylene glycol; diethers of 1,6-hexylene glycol, such as 1,6-hexylene glycol diethyl ether, 1,6-hexylene glycol dipropyl ether, 1,6-hexylene glycol dibutyl ether, 1,6-hexylene glycol dipentyl ether, 1,6-hexylene glycol dihexyl ether, 1,6-hexylene glycol diheptyl ether, 1,6-hexylene glycol dioctyl ether, 1,6-hexylene glycol dinonyl ether, 1,6-hexylene glycol didecyl ether, 1,6-hexylene glycol dicyclohexyl ether, 1,6-hexylene glycol diphenyl ether, 1,6-hexylene glycol ditolyl ether, 1,6-hexylene glycol dixylyl ether, 1,6-hexylene glycol butyl naphthyl ether, 1,6-hexylene glycol dibenzyl ether, 1,6-hexylene glycol ethyl butyl ether, 1,6-hexylene glycol butyl hexyl ether, and 1,6-hexylene glycol butyl 2-ethylhexyl ether, and similar diethers of 1,2-hexylene glycol, 1,3-hexylene glycol, 1,4-hexylene glycol, 1,5-hexylene glycol, 2,3-hexylene glycol, 2,4-hexylene glycol, 2,5-hexylene glycol or 3,4-hexylene glycol; diethers of 1,7-heptylene glycol, such as 1,7-heptylene glycol diethyl ether, 1,7-heptylene glycol dipropyl ether, 1,7-heptylene glycol dibutyl ether, 1,7-heptylene glycol dicyclohexyl ether, 1,7-heptylene glycol diphenyl ether, 1,7-heptylene glycol dibenzyl ether, and 1,7-heptylene glycol ethyl butyl ether, and similar diethers of 1,2-heptylene glycol, 1,3-heptylene glycol, 1,4-heptylene glycol, 1,5-heptylene glycol, 1,6-heptylene glycol, 2,3-heptylene glycol, 2,4-heptylene glycol, 2,5-heptylene glycol, 2,6-heptylene glycol, 3,4-heptylene glycol or 3,5-heptylene glycol; and diethers of 1,8-octylene glycol, such as 1,8-octylene glycol diethyl ether, 1,8-octylene glycol dipropyl ether, 1,8-octylene glycol dibutyl ether, 1,8-octylene glycol dicyclohexyl ether, 1,8-octylene glycol diphenyl ether, 1,8-octylene glycol dibenzyl ether, and 1,8-octylene glycol ethyl butyl ether, and similar diethers of 1,2-octylene glycol, 1,3-octylene glycol, 1,4-octylene glycol, 1,5-octylene glycol, 1,6-octylene glycol, 1,7-octylene glycol, 2,3-octylene glycol, 2,4-octylene glycol, 2,5-octylene glycol, 2,6-octylene glycol, 2,7-octylene glycol, 3,4-octylene glycol, 3,5-octylene glycol, 3,6-octylene glycol or 4,5-octylene glycol.

The ether compounds of formula (I) wherein x is 2, i.e., diethers of diglycols, include diethers of di-1,4-butylene glycol, such as di-1,4-butylene glycol diethyl ether, di-1,4-butylene glycol dipropyl ether, di-1,4-butylene glycol dibutyl ether, di-1,4-butylene glycol dipentyl ether, di-1,4-butylene glycol dihexyl ether, di-1,4-butylene glycol diheptyl ether, di-1,4-butylene glycol dioctyl ether, di-1,4-butylene glycol dinonyl ether, di-1,4-butylene glycol didecyl ether, di-1,4-glycol dicyclohexyl ether, di-1,4-butylene glycol diphenyl ether, di-1,4-butylene glycol ditolyl ether, di-1,4-butylene glycol dixylyl ether, di-1,4-butylene glycol butyl naphthyl ether, di-1,4-butylene glycol dibenzyl ether, di-1,4-butylene glycol ethyl butyl ether, di-1,4-butylene glycol butyl hexyl ether, and di-1,4-butylene glycol butyl 2-ethylhexyl ether; and similar diethers of di-1,2-butylene glycol, di-1,3-butylene glycol, di-2,3-butylene glycol, di-1,2-pentylene glycol, di-1,3-pentylene glycol, di-1,4-pentylene glycol, di-1,5-pentylene glycol, di-2,3-pentylene glycol, di-2,4-pentylene glycol, di-1,5-hexylene glycol, di-1,6-hexylene glycol, di-1,7-heptylene glycol or di-1,8-octylene glycol.

The ether compounds represented by formula (II) will be explained below in detail. Since the compounds (II) have only one ethereal polar group in the molecule, they are structurally close to conventionally employed paraffin solvents and have substantially the same characteristics as a carrier liquid, such as electrical resistivity, as those of conventional carrier liquids. Accordingly, the compounds (II) can be used in accordance with the known techniques applied to conventional carrier liquids and, besides, meet both the demands for low viscosity and low vaporizability.

Thus, use of the ether compounds (II) as a carrier liquid provides a liquid developer having a reduced viscosity and thereby suitability to high-speed copying.

The ether compounds (II) include alkyl ethers, alicyclic alkyl ethers, aryl ethers, and aralkyl ethers.

The alkyl ethers include simple dialkyl ethers, such as di-n-butyl ether, di-n-pentyl ether, di-n-hexyl ether, di-n-heptyl ether, di-n-octyl ether, di-n-nonyl ether, and di-n-decyl ether, and mixed ethers, such as n-propyl n-pentyl ether, n-propyl n-hexyl ether, n-propyl n-heptyl ether, n-propyl n-octyl ether, n-butyl n-pentyl ether, n-butyl n-hexyl ether, n-butyl n-heptyl ether, n-butyl n-octyl ether, n-butyl n-nonyl ether, n-butyl n-decyl ether, n-butyl n-undecyl ether, n-butyl n-dodecyl ether, n-pentyl n-hexyl ether, n-pentyl n-heptyl ether, n-pentyl n-octyl ether, n-pentyl n-nonyl ether, n-pentyl n-decyl ether, n-pentyl n-undecyl ether, n-pentyl n-dodecyl ether, n-hexyl n-heptyl ether, n-hexyl n-octyl ether, n-hexyl n-nonyl ether, n-hexyl n-decyl ether, n-hexyl n-undecyl ether, n-hexyl n-dodecyl ether, n-heptyl n-octyl ether, n-heptyl n-nonyl ether, n-heptyl n-decyl ether, n-heptyl n-undecyl ether, n-heptyl n-dodecyl ether, n-octyl n-nonyl ether, n-octyl n-decyl ether, n-octyl n-undecyl ether, n-octyl n-dodecyl ether, n-nonyl n-decyl ether, and n-nonyl n-undecyl ether. Additionally, the above-enumerated alkyl ethers with the n-alkyl group thereof being replaced with its structural isomer, i.e., an iso-, sec- or t-alkyl group, are also useful.

These alkyl ethers are particularly effective to suppress increases in viscosity and solidifying point as have occurred with paraffin oils or isoparaffin oils.

The alicyclic alkyl ethers include dicyclopentyl ether, dicyclohexyl ether, dimethylcyclohexyl ether, n-butyl cyclopentyl ether, n-hexyl cyclopentyl ether, n-octyl cyclopentyl ether, n-decyl cyclopentyl ether, n-butyl cyclohexyl ether, n-hexyl cyclohexyl ether, n-octyl cyclohexyl ether, n-decyl cyclohexyl ether, cyclopentyl cyclohexyl ether, cyclohexyl methylcyclohexyl ether, and cyclopentyl methylcyclohexyl ether. In these alicyclic alkyl ethers, the n-alkyl group may be replaced with its structural isomer, i.e., an iso-, sec- or t-alkyl group.

The alicyclic alkyl ethers are particularly effective to improve dissolving power for a charge control agent to thereby stabilize the charge imparting characteristics.

The aryl ethers and aralkyl ethers include diphenyl ether, ditolyl ether, dibenzyl ether, diphenethyl ether, diphenylpropyl ether, n-butyl phenyl ether, n-hexyl phenyl ether, n-octyl phenyl ether, n-butyl tolyl ether, n-hexyl tolyl ether, n-butyl benzyl ether, ethyl naphthyl ether, n-butyl naphthyl ether, and n-pentyl naphthyl ether. In these ethers, the n-alkyl group may be replaced with its structural isomer, i.e., an iso-, sec- or t-alkyl group.

The aryl or aralkyl ethers are particularly effective to control the evaporation loss of a carrier liquid from a copying machine and also effective to improve charge imparting properties.

The ether compounds (I) and (II) according to the present invention may be used either individually or in combination of two or more thereof. They may also be used in combination with conventional carrier liquids. Suitable conventional carrier liquids with which the ether compounds of the present invention may be combined include branched aliphatic hydrocarbons, such as Isopar G, H, L, M or V; straight chain aliphatic hydrocarbons, such as Norpar 14, 15 or 16 (produced by Exxon); waxy hydrocarbons having a relatively high molecular weight, such as n-undecane, n-dodecane, n-tridecane, n-tetradecane, n-pentadecane, n-hexadecane, n-heptadecane, n-octadecane, and n-nonadecane; halogenated hydrocarbons of the above-mentioned hydrocarbons, such as fluorocarbons; silicon oils; and modified silicon compounds. The conventional carrier liquid may be used in an amount of 5 to 95 wt % of the ether compound of the present invention.

When used in combination with a paraffin hydrocarbon having a relatively high molecular weight, the ether compound of the present invention reduces the solidifying point of the paraffin hydrocarbon from around room temperature to a range causing no practical problem. Further, the ether compound is effective to improve charging characteristics of a paraffin hydrocarbon.

When combined with other carrier liquids, the proportion of the ether compound of the present invention in the total carrier liquid is suitably 5 to 100 wt %, more preferably 20 to 100 wt %. If it is less than 5% by weight, the effect of reducing a solidifying point of an aliphatic hydrocarbon having a high molecular weight or the effect of reducing the vapor pressure of a paraffin oil having a low molecular weight would be insufficient. The effect on improvement of charging characteristics would also be insufficient.

The binder resin which can be used in toner particles includes polyolefins, such as polyethylene and polypropylene. Particularly preferred binder resins are ethylene copolymers having a polar group, such as copolymers of ethylene and an α,β-ethylenically unsaturated acid (e.g., acrylic acid or methacrylic acid) or an alkyl esther thereof or ionomers prepared by subjecting these ethylene copolymers to ionic crosslinking. For details of synthesis of copolymers of this type, refer to U.S. Pat. No. 3,264,272 to Ree.

In addition, homopolymers of styrene or a styrene derivative, such as o-, m- or p-methylstyrene, α-methylstyrene, p-ethylstyrene or 2,4-dimethylstyrene, and styrene copolymers comprising styrene and an acrylic monomer or other copolymerizable monomers are also useful as a binder resin.

The acrylic monomer in the above-mentioned styrene copolymers includes acrylic or methacrylic esters, such as methyl (meth)acrylate, ethyl (meth)acrylate, propyl (meth-)acrylate, n-butyl (meth)acrylate, isobutyl (meth)acrylate, n-hexyl (meth)acrylate, n-octyl (meth)acrylate, 2-ethylhexyl (meth)acrylate, decyl (meth)acrylate, lauryl (meth)acrylate, stearyl (meth)acrylate, 2-chloroethyl (meth)acrylate, and phenyl (meth)acrylate; α-methylene monocarboxylic acid esters, such as dimethylaminoethyl methacrylate and diethylaminoethyl methacrylate; ammonium methacrylate; and betaine compounds thereof.

Other useful binder resins include homopolymers of the above-mentioned (meth)acrylic acids or esters thereof; homopolymers or copolymers of perfluorooctyl (meth)acrylate, vinyltoluenesulfonic acid or a sodium salt thereof, or a vinylpyridine compound or a pyridinium salt thereof; copolymers of a diene, e.g., butadiene or isoprene, and a vinyl monomer; and dimeric acid-based polyamide resins. Additionally, polyester resins, polyurethane resins, and the like may also be used either individually or in combination with the above-described resins.

The colorants which can be dispersed in the binder resin include organic or inorganic pigments or dyes. Examples of suitable colorants are C.I. Pigment Red 48:1, C.I. Pigment Red 57:1, C.I. Pigment Red 122, C.I. Pigment Red 17, C.I. Pigment Yellow 97, C.I. Pigment Yellow 12, C.I. Pigment Blue 15:1, C.I. Pigment Blue 15:3, lamp black (C.I. No. 77266), Rose Bengal (C.I. No. 45432), carbon black, nigrosine (C.I. No. 50415B), and mixtures thereof. In addition, various metal oxides, such as silica, aluminum oxide, magnetite, ferrites, cupric oxide, nickel oxide, zinc oxide, zirconium oxide, titanium oxide, and magnesium oxide, and mixtures thereof may be employed.

The colorant is used in a sufficient amount enough to form a visible image with sufficient density. Such an amount usually ranges from 1 to 100 parts by weight per 100 parts by weight of the binder resin, while depending on the size of toner particles and the proportion of charged toner particles.

The proportion of the toner particles of the present invention in the total carrier liquid is preferably 0.1 to 5 wt %, more preferably 0.5 to 2 wt %.

Toner particles and a liquid developer can be prepared by any of known methods, such as those described in the literature of Metcalfe supra, JP-A-58-2851, JP-A-58-129438, JP-A-58-152258, and U.S. Pat. No. 4,794,651 to B. Landa, et al.

For example, a toner can be prepared by a method comprising dispersing and kneading a binder resin, a colorant and a carrier liquid in an appropriate apparatus at a temperature at which the resin can be plasticized, the carrier liquid is prevented from boiling, and the resin and/or the colorant is prevented from decomposing. More specifically, a resin and a colorant are heat-melted in a carrier liquid by means of a planetary mixer, a kneader, etc., and the molten mixture is cooled while stirring to solidify and precipitate toner particles by taking advantage of the temperature dependence of the degree of resin's melting in a solvent.

There is another method for toner preparation, in which a resin, a colorant, and a carrier liquid are dispersed and kneaded in a vibration mill equipped with a granular medium for dispersion and kneading, such as an attritor or a ball mill, heated at an appropriate temperature, e.g., 80° to 160° C. Suitable granular media include stainless steel, carbon steel, alumina, zirconia and silica. In carrying out this method, the starting materials, having been sufficiently fluidized, are dispersed in the mill with the aid of the granular medium, and the carrier liquid is cooled to precipitate the resin as containing the colorant. It is important to keep the granular medium in a dispersed state to give shear and/or impact to toner particles thereby reducing the toner particle size.

The thus prepared toner particles preferably have a volume average particle size of smaller than 10 μm, and more preferably 5 μm or smaller, as determined with a centrifugal particle size distribution measuring apparatus. If desired, the particles may have a shape with a fibrous surface, i.e., a shape with numeral fibers, curling whiskers, tentacles, etc.

A still another method for preparing a liquid developer comprises melting a weighed quantity of a resin by heating, adding a weighed quantity of a colorant to the molten resin at a prescribed mixing ratio, dispersing the mixture, cooling, grinding the solidified mixture to fine particles by means of a grinding machine, such as a jet mill, a hammer mill, a turbo mill, etc., and dispersing the resulting toner particles in a carrier liquid.

Toner particles may also be prepared by polymerization (suspension polymerization, emulsion polymerization or dispersion polymerization), coacervation, melt dispersion, or emulsion coagulation. The resulting toner particles are then dispersed in a carrier liquid.

If desired, a charge control agent may be incorporated into a carrier liquid or toner particles for the purpose of ensuring uniformity and stability of polarity and quantity of charges. Charge control agents conventionally used in a liquid developer, such as lecithin, Basic Barium Petronate, Basic Sodium Petronate or Basic Calcium Petronate (produced by Witoco Chemical Corp.), oil-soluble petroleum sulfonates, alkylsuccinimides, dioctyl sodium sulfosuccinate, and metallic soaps, e.g., zirconium octanoate, can be used in the present invention. Additionally, ionic or nonionic surfactants, metallized dyes, quaternary ammonium salts, organic or inorganic salts, such as organic borates, and block or graft copolymers having a lipophilic part and a hydrophilic part can also be used as a charge control agent.

If desired, the liquid developer of the present invention may further contain fine polymer particles, inorganic particles or any other additives for improving various physical properties.

The present invention will now be illustrated in greater detail with reference to Examples, but the present invention should not be construed as being limited thereto. In the Examples, all the parts, percents, and ratios are by weight unless otherwise indicated.

EXAMPLE 1

| | |
|---|---|
| Ethylene (89%)-methacrylic acid (11%) copolymer ("Nucrel N699", produced by E. I. du Pont de Nemours & Co., Inc.) | 40 parts |
| Copper phthalocyanine pigment ("Cyanine Blue 4933M" produced by Dainichiseika Colour & Chemicals Mfg. Co., Ltd.) | 4 parts |
| Norpar 15 | 100 parts |

The above components were charged in a stainless steel-made beaker and heated to 120° C. on an oil bath for 1 hour while stirring to prepare a uniform, completely molten mixture. The mixture was gradually cooled to room temperature with stirring, and 100 parts of Norpar 15 was added thereto. As the temperature of the system decreased, pigment-containing particles having a particle diameter of from 10 to 20 μm began to precipitate.

A 100 g portion of the precipitated toner was put in an attritor ("Model 01" manufactured by Mitsui Miike K. K.) and ground with steel balls having a diameter of 0.8 mm at 300 rpm while monitoring the volume average particle size with a centrifugal particle size distribution meter ("SA-CP4L" manufactured by Shimadzu Corporation). Grinding was continued until the volume average particle size was reduced to 2.5 μm (for about 20 hours). The resulting concentrated toner having a toner concentration of 18% was used as a base toner.

Twenty parts of the base toner were diluted with 160 parts of pentylene glycol dibutyl ether to a toner concentration of 2%, followed by thoroughly stirring. To the mixture was added 0.1 part, per part of the toner, of Basic Barium Petronate (hereinafter abbreviated as BBP) as a charge director, followed by thoroughly stirring to prepare a liquid developer.

EXAMPLE 2

Twenty parts of the base toner obtained in Example 1 were diluted with 160 parts of hexylene glycol ethyl butyl ether to a toner concentration of 2%. After thorough stirring, Basic Sodium Petronate (hereinafter abbreviated as BSP) was added thereto as a charge director in the same proportion as used in Example 1, and the mixture was thoroughly stirred to prepare a liquid developer.

EXAMPLE 3

| | |
|---|---|
| Polyester resin (prepared by polymerization of terephthalic acid and ethylene oxide-added bisphenol A; weight average molecular weight: 12000; acid value: 5; softening point: 110° C.) | 85 parts |
| Magenta pigment ("Carmine 6B" produced by Dainichiseika Colour & Chemicals Mfg. Co., Ltd.) | 15 parts |

The above components were kneaded in an extruder, ground in a jet mill, and classified by an air classifier to prepare a toner having an average particle size of 3 μm.

The resulting toner was dispersed in butylene glycol dioctyl ether in a concentration of 2%, and Basic Calcium Petronate (hereinafter abbreviated as BCP) was added thereto as a charge director in the same proportion as used in Example 1, followed by thoroughly stirring to prepare a liquid developer.

EXAMPLE 4

A concentrated toner was prepared in the same manner as in Example 1, except for using "Pigment Yellow 17" (produced by Dainichiseika Colour & Chemicals Mfg. Co., Ltd.) as a colorant, and the resulting base toner was diluted with pentylene glycol dibutyl ether in the same manner as in Example 1.

To the mixture was added dioctyl sodium sulfosuccinate as a charge director in the same proportion as in Example 1, followed by thoroughly stirring to obtain a liquid developer.

EXAMPLE 5

| | |
|---|---|
| Ethylene (85%)-methacrylic acid (10%)-octyl methacrylate (5%) copolymer | 40 parts |
| Pigment Yellow 17 | 4 parts |
| Norpar 15 | 100 parts |

A base toner was prepared from the above components in the same manner as in Example 1. Twenty parts of the base toner (toner concentration: 18%) were diluted with 160 parts of hexylene glycol dibutyl ether to a toner concentration of 2%. After thorough stirring, a charge director was added thereto in the same manner as in Example 1 to prepare a liquid developer.

EXAMPLE 6

A liquid developer was prepared in the same manner as in Example 1, except for using carbon black ("Regal 330" produced by Cabot G. L. Inc.) as a colorant. The toner had a particle size of 2.5 μm.

COMPARATIVE EXAMPLE 1

A liquid developer was prepared in the same manner as in Example 1, except for diluting the base toner with Isopar L to a toner concentration of 2%.

COMPARATIVE EXAMPLE 2

The base toner prepared in Example 1 was diluted with Isopar H to a toner concentration of 2%. Soybean lecithin was added thereto as a charge director in the same proportion as in Example 1, and the mixture was thoroughly stirred to prepare a liquid developer.

The composition of the liquid developers prepared in Examples 1 to 5 and Comparative Examples 1 to 2 is tabulated in Table 1 below.

Each of the liquid carriers used in Examples and Comparative Examples and liquid developers prepared in these Examples was evaluated in accordance with the following test methods.

1) Rate of Evaporation of Carrier Liquid

Three grams of the carrier liquid used in each liquid developer was put in a glass petri dish (opening diameter: 50 mm), and the dish was left on a hot plate kept at 40° C. for a prescribed period of time (x hours), and the evaporation loss (g) was measured with a precision weighing machine. The rate of evaporation per unit area per unit time was obtained from equation:

$$\text{Rate of evaporation } (g/m^2 \bullet h) = \text{Evaporation loss (g) after x hours} / \text{opening area } (m^2) \bullet x \text{ (hr)}$$

2) Quantities of Charged Toner and Oppositely Charged Toner

Three milliliters of the liquid developer was filled in a 1 mm gap between parallel disc electrodes (diameter: 10 cm; electrode area: about 78 $cm^2$), and a voltage of 1000 V was applied thereto for 1 second to provide an electrical field of $+10^4$ V/cm. The electrode on which the toner deposited was dried in a vacuum drier at 120° C. for 2 hours to completely remove the carrier liquid. The quantity of the normally charged toner was obtained from the difference in weight of the electrode before and after toner deposition. The same procedure was followed, except for changing the polarity of the voltage applied, to determine the quantity of the toner charged to the opposite polarity. The circuit diagram of the apparatus used in the above measurement is shown in FIGURE. In FIGURE, 1 shows a pulse oscillator, 2 shows a high-voltage powder supply apparatus, 3 shows an electrode, 4 shows an ammeter and 5 shows a current waveform analyzer.

3) Solidifying point of Carrier Liquid

The carrier liquid was allowed to stand at 20° C., 0° C., −10° C. or −20° C., and the temperature at which the sample solidified was taken as a solidifying point for the sake of simplicity. The results of theses tests are shown in Table 2 below.

TABLE 1

| | Toner Composition | | | |
|---|---|---|---|---|
| Example No. | Binder Resin | Pigment | Charge Director | Carrier Liquid |
| Example 1 | ethylene-methacrylic acid copolymer | copper phthalocyanine | BBP | pentylene glycol dibutyl ether |
| Example 2 | ethylene-methacrylic acid copolymer | copper phthalocyanine | BSP | hexylene glycol ethyl butyl ether |
| Example 3 | polyester resin | Carmine 6B | BCP | butylene glycol dioctyl ether |
| Example 4 | ethylene-methacrylic acid copolymer | Pigment Yellow 17 | dioctyl sodium sulfosuccinate | pentylene glycol dibutyl ether |
| Example 5 | ethylene-methacrylic acid- | " | BBP | hexylene glycol dibutyl ether |

TABLE 1-continued

| Example No. | Toner Composition: Binder Resin | Pigment | Charge Director | Carrier Liquid |
|---|---|---|---|---|
| | octyl methacrylate copolymer | | | |
| Example 6 | ethylene-methacrylic acid copolymer | carbon black | " | pentylene glycol dibutyl ether |
| Compar. Example 1 | ethylene-methacrylic acid copolymer | copper phthalocyanine | " | Isopar L |
| Compar. Example 2 | ethylene-methacrylic acid copolymer | Carmine 6B | soybean lecithin | Isopar H |

TABLE 2

| Example No. | Rate of Evaporation of Carrier Liquid ($g/m^2 \cdot hr$) | Toner Charging Polarity | Normally Charged Toner Quantity: Immediately after Preparation (mg) | Normally Charged Toner Quantity: 7 Days after Preparation (mg) | Oppositely Charged Toner Quantity: Immediately after Preparation (mg) | Oppositely Charged Toner Quantity: 7 Days after Preparation (mg) |
|---|---|---|---|---|---|---|
| Example 1 | 4.0 | negative | 21.3 | 22.0 | 0.0 | 0.0 |
| Example 2 | 3.8 | negative | 20.5 | 21.0 | 0.1 | 0.1 |
| Example 3 | 2.4 | negative | 21.0 | 21.5 | 0.0 | 0.1 |
| Example 4 | 4.0 | positive | 25.8 | 26.0 | 0.0 | 0.1 |
| Example 5 | 3.8 | negative | 20.7 | 21.0 | 0.0 | 0.0 |
| Example 6 | 4.0 | negative | 21.5 | 22.0 | 0.0 | 0.0 |
| Compar. Example 1 | 115 | negative | 10.5 | 10.1 | 1.9 | 3.4 |
| Compar. Example 2 | 132 | negative | 10.1 | 9.8 | 2.0 | 3.1 |

As is apparent from Table 2, the carrier liquids used in Examples 1 to 6 have a rate of evaporation greatly reduced to about 1/29 to 1/55 of that of conventional carrier liquids as used in Comparative Examples 1 and 2.

The toners of the developers of Examples 1, 2, 3, 5 and 6 exhibit satisfactory negative chargeability with substantially no chargeability to opposite polarity, and their charging characteristics were stable over 7 days from the preparation. The toner of the developer of Example 4 exhibits satisfactory positive chargeability with substantially no chargeability to opposite polarity, and the charging characteristics were stable with time. To the contrary, the charged toner quantity of the developers of Comparative Examples 1 and 2 was about a half of those in Examples 1 to 6 or even lower and, moreover, the proportion of the toner quantity charged to opposite polarity was considerably high.

EXAMPLE 7

A liquid developer having a toner concentration of 2% was prepared in the same manner as in Example 1, except for diluting the base toner with a 1:1 mixture of pentylene glycol dibutyl ether and Norpar 15.

EXAMPLE 8

A liquid developer having a toner concentration of 2% was prepared in the same manner as in Example 1, except for diluting the base toner with a 1:1 mixture of hexylene glycol dibutyl ether and Isopar L.

COMPARATIVE EXAMPLE 3

A liquid developer having a toner concentration of 2% was prepared in the same manner as in Example 1, except for diluting the base toner with Norpar 15.

The rate of evaporation and solidifying point of the carrier liquid used in Examples 7 and 8 and Comparative Example 3 were measured in the same manner as described above. The results obtained are shown in Table 3 below.

TABLE 3

| Example No. | Carrier Liquid | Rate of Evaporation ($g/m^2 \cdot hr$) | Solidifying Point (°C.) |
|---|---|---|---|
| Example 7 | pentylene glycol dibutyl ether: Norpar 15 = 1:1 | 4.2 | 0 to −10 |
| Example 8 | hexylene glycol dibutyl ether: Isopar L = 1:1 | 8.8 | <−20 |
| Compar. Example 3 | Norpar 15 | 4.5 | 0 |

As is apparent from Table 3, the carrier liquid of Example 7 has a rate of evaporation of 4.2 $g/m^2 \bullet hr$ and a solidifying point between 0° and −10° C., both of which are satisfactory for practical use. The rate of evaporation of the carrier liquid of Example 8 is 8.8 g/m$^2$•hr, which is considerably lower than that of Isopar L alone. To the contrary, the solidifying point of the carrier liquid of Comparative Example 3 is 0° C., which means that the developer becomes waxy in winter, needing to be heated on use.

The liquid developer prepared in Example 2 was used for actual image formation by a copying machine "FX-5030" (manufactured by Fuji Xerox Co., Ltd.) wherein its black-color developing unit portion was modified for application of a liquid developer. As a result, satisfactory copies of high resolving power were obtained. When copies were taken continuously, the 100th copy was equal in quality to those obtained in the initial stage.

EXAMPLE 9

| | |
|---|---|
| Ethylene (89%)-methacrylic acid (11%) copolymer (Nucrel N699) | 40 parts |
| Copper phthalocyanine pigment (Cyanine Blue 4933M) | 4 parts |
| Norpar 15 | 100 parts |

The above components were charged in a stainless steel-made beaker and heated to 120° C. on an oil bath for 1 hour while stirring to prepare a uniform, completely molten mixture. The mixture was gradually cooled to room temperature with stirring, and 100 parts of Norpar 15 was added thereto. As the temperature of the system decreased, pigment-containing particles having a particle diameter of from 10 to 20 μm began to precipitate.

A 100 g portion of the precipitated toner was put in an attritor (Model 01) and ground with steel balls having a diameter of 0.8 mm at 300 rpm while monitoring the volume average particle size with a centrifugal particle size distribution meter (SA-CP4L). Grinding was continued until the volume average particle size was reduced to 2.5 μm (for about 20 hours). The resulting concentrated toner having a toner concentration of 18% was used as a base toner.

Twenty parts of the base toner were diluted with parts of diheptyl ether to a toner concentration of 2%, followed by thoroughly stirring. To the mixture was added 0.1 part, per part of the toner, of BBP as a charge director, followed by thoroughly stirring to prepare a liquid developer.

EXAMPLE 10

Twenty parts of the base toner obtained in Example 9 were diluted with 160 parts of dioctyl ether to a toner concentration of 2%. BSP was added thereto as a charge director in the same proportion as used in Example 9, and the mixture was thoroughly stirred to prepare a liquid developer.

EXAMPLE 11

| | |
|---|---|
| Polyester resin (prepared by polymerization of terephthalic acid and ethylene oxide-added bisphenol A; weight average molecular weight: 12000; acid value: 5; softening point: 110° C.) | 85 parts |
| Magenta pigment ("Carmine 6B") | 15 parts |

The above components were kneaded in an extruder, ground in a jet mill, and classified by an air classifier to prepare a toner having an average particle size of 3 μm.

The resulting toner was dispersed in diphenyl ether in a concentration of 2%, and BCP was added thereto as a charge director in the same proportion as in Example 9, followed by thoroughly stirring to prepare a liquid developer.

EXAMPLE 12

A concentrated toner was prepared in the same manner as in Example 9, except for using Pigment Yellow 17 as a colorant, and the resulting base toner was diluted with diheptyl ether in the same manner as in Example 9.

To the mixture was added dioctyl sodium sulfosuccinate as a charge director in the same proportion as in Example 9, followed by thoroughly stirring to obtain a liquid developer.

EXAMPLE 13

| | |
|---|---|
| Ethylene (85%)-methacrylic acid (10%)-octyl methacrylate (5%) copolymer | 40 parts |
| Pigment Yellow 17 | 4 parts |
| Norpar 15 | 100 parts |

A base toner was prepared from the above components in the same manner as in Example 9. Twenty parts of the base toner (toner concentration: 18%) were diluted with 160 parts of butyl 2-ethylhexyl ether to a toner concentration of 2%, and the mixture was thoroughly stirred. A charge director was added thereto in the same manner as in Example 9 to prepare a liquid developer.

EXAMPLE 14

A liquid developer was prepared in the same manner as in Example 9, except for using carbon black (Regal 330) as a colorant. The toner had a particle size of 2.5 μm.

COMPARATIVE EXAMPLE 4

A liquid developer was prepared in the same manner as in Example 9, except for diluting the base toner with Isopar L to a toner concentration of 2%.

COMPARATIVE EXAMPLE 5

The base toner prepared in Example 9 was diluted with Isopar H to a toner concentration of 2%. Soybean lecithin was added thereto as a charge director in the same proportion as in Example 9, and the mixture was thoroughly stirred to prepare a liquid developer.

The composition of the liquid developers prepared in Examples 9 to 14 and Comparative Examples 4 to 5 is tabulated in Table 4 below.

Each of the liquid carriers and developers was evaluated in the same manner as in Example 1. The results obtained are shown in Table 5 below.

TABLE 4

| Example No. | Toner Composition: Binder Resin | Pigment | Director | Carrier Liquid |
|---|---|---|---|---|
| Example 9 | ethylene-methacrylic acid copolymer | copper phthalocyanine | BBP | diheptyl ether |
| Example 10 | ethylene-methacrylic acid copolymer | copper phthalocyanine | BSP | dioctyl ether |
| Example 11 | polyester resin | Carmine 6B | BCP | diphenyl ether |
| Example 12 | ethylene-methacrylic acid copolymer | Pigment Yellow 17 | dioctyl sodium sulfosuccinate | diheptyl ether |
| Example 13 | ethylene-methacrylic acid-octyl methacrylate copolymer | " | BBP | butyl 2-ethyl-hexyl ether |
| Example 14 | ethylene-methacrylic acid copolymer | carbon black | " | diheptyl ether |
| Compar. Example 4 | ethylene-methacrylic acid copolymer | copper phthalocyanine | " | Isopar L |
| Compar. Example 5 | ethylene-methacrylic acid copolymer | copper phthalocyanine | soybean lecithin | Isopar H |

TABLE 5

| Example No. | Rate of Evaporation of Carrier Liquid ($g/m^2 \cdot hr$) | Toner Charging Polarity | Normally Charged Toner Quantity: Immediately after Preparation (mg) | Normally Charged Toner Quantity: 7 Days after Preparation (mg) | Oppositely Charged Toner Quantity: Immediately after Preparation (mg) | Oppositely Charged Toner Quantity: 7 Days after Preparation (mg) |
|---|---|---|---|---|---|---|
| Example 9 | 1.92 | negative | 25.5 | 25.0 | 0.1 | 0.0 |
| Example 10 | 0.51 | negative | 24.3 | 25.0 | 0.0 | 0.1 |
| Example 11 | 0.43 | negative | 32.0 | 31.2 | 0.1 | 0.1 |
| Example 12 | 1.92 | negative | 23.9 | 24.2 | 0.1 | 0.1 |
| Example 13 | 2.30 | positive | 33.0 | 32.8 | 0.1 | 0.1 |
| Example 14 | 1.92 | negative | 26.0 | 26.1 | 0.0 | 0.1 |
| Compar. Example 4 | 89.2 | negative | 10.5 | 10.1 | 1.9 | 3.4 |
| Compar. Example 5 | 118 | negative | 10.1 | 9.8 | 2.0 | 3.1 |

As is apparent from Table 5, the carrier liquids used in Examples 9 to 14 have a rate of evaporation greatly reduced to about 1/39 to 1/274 of that of conventional carrier liquids as used in Comparative Examples 4 and 5.

The toners of the developers of Examples 9 to 12 and 14 each exhibit satisfactory negative chargeability with substantially no chargeability to opposite polarity, and their charging characteristics were stable over 7 days from the preparation. The toner of the developer of Example 13 exhibits satisfactory positive chargeability with substantially no chargeability to opposite polarity, and the charging characteristics were stable with time. To the contrary, the charged toner quantity of the developers of Comparative Examples 4 and 5 was about a half of those in Examples 9 to 14 or even lower and, moreover, the proportion of the toner quantity charged to opposite polarity was considerably high.

EXAMPLE 15

A liquid developer having a toner concentration of 2% was prepared in the same manner as in Example 9, except for diluting the base toner with a 1:1 mixture of dioctyl ether and Norpar 15.

EXAMPLE 16

A liquid developer having a toner concentration of 2% was prepared in the same manner as in Example 9, except for diluting the base toner with a 1:1 mixture of diphenyl ether and Isopar L.

COMPARATIVE EXAMPLE 6

A liquid developer having a toner concentration of 2% was prepared in the same manner as in Example 9, except for diluting the base toner with Norpar 15.

The rate of evaporation and solidifying point of the carrier liquid used in Examples 15 and 16 and Comparative Example 6 were measured in the same manner as described above. The results obtained are shown in Table 6 below.

TABLE 6

| Example No. | Carrier Liquid | Rate of Evaporation ($g/m^2 \cdot hr$) | Solidifying Point (°C.) |
|---|---|---|---|
| Example 15 | dioctyl glycol ether:Norpar 15 = 1:1 | 0.82 | 0 to −10 |
| Example 16 | diphenyl ether: Isopar L = 1:1 | 1.03 | <−20 |
| Compar. Example 6 | Norpar 15 | 2.5 | 0 |

As is apparent from Table 6, the carrier liquid of Example 15 has a rate of evaporation of 0.82 $g/m^2 \bullet hr$ and a solidifying point between 0° and −10° C., both of which are satisfactory for practical use. The rate of evaporation of the carrier liquid of Example 16 is 1.03 $g/m^2 \bullet hr$, which is considerably lower than that of Isopar L alone. To the contrary, the solidifying point of the carrier liquid of Comparative Example 6 is 0° C., which means that the developer becomes waxy in winter, needing to be heated on use.

The liquid developer prepared in Example 10 was used for actual image formation in the same manner as described above. As a result, satisfactory copies of high resolving power were obtained. When copies were taken continuously, the 100th copy was equal in quality to those obtained in the initial stage.

As discussed above, the characteristic of the present invention consists in use of the ether compound represented by formula (I) or (II) as a carrier liquid of a liquid developer. The carrier liquids according to the present invention have adequate characteristics in terms of insulating properties, viscosity, dissolving power for a toner binder, and pour point. Further, they have markedly lower solidifying point and vapor pressure than those of conventional carrier liquids. As a result, they do not need heating even in winter, and they have a reduced evaporation loss and less danger of fire. Additionally, the carrier liquids of the present invention exhibit satisfactory charging properties to impart charges to toner particles in a stable manner with time. Thus, the liquid developer according to the present invention is very satisfactory for practical use.

While the invention has been described in detail and with reference to specific examples thereof, it will be apparent to one skilled in the art that various changes and modifications can be made therein without departing from the spirit and scope thereof.

What is claimed is:

1. A liquid developer for electrophotography comprising a carrier liquid and tone particles dispersed therein, said toner particles containing a binder resin and a colorant, wherein 20–100% by weight of said carrier liquid contains at least one ether compound selected from the group consisting of compounds represented by formula (I) and compounds represented by formula (II)

$$R_1—O(C_nH_{2n}O)_x—R_2 \quad (I)$$

$$R_3—O—R_4 \quad (II)$$

wherein $R_1$, $R_2$, $R_3$, and $R_4$, which are the same or different, each represent an alkyl group, an alicyclic alkyl group, an aryl group, or an aralkyl group; n represents an integer of from 4 to 8; and x represents 1 or 2.

2. A liquid developer for electrophotography as claimed in claim 1, wherein $R_1$ and $R_2$ in formula (I) have from 4 to 20 carbon atoms in total.

3. A liquid developer for electrophotography as claimed in claim 1, wherein $R_3$ and $R_4$ in formula (II) have from 8 to 20 carbon atoms in total.

4. A liquid developer for electrophotography as claimed in claim 1, wherein 100% by weight of said carrier liquid is said at least one ether compound.

5. A liquid developer for electrophotography comprising a carrier liquid and toner particles dispersed therein, said toner particles containing a binder resin and a colorant, wherein said carrier liquid contains at least one ether compound represented by formula (I):

$$R_1—O(C_nH_{2n}O)_x—R_2 \quad (I)$$

wherein $R_1$ and $R_2$, which are the same or different, each represent an alkyl group, an alicyclic alkyl group, an aryl group or an aralkyl group; n represents an integer from 4 to 8; and x represents 1 or 2, wherein 20 to 100% by weight of said carrier liquid is said at least one ether compound.

6. A liquid developer for electrophotography as claimed in claim 5, wherein 100% by weight of said carrier liquid is said at least one ether compound.

* * * * *